US007232161B2

(12) United States Patent
Matsuda et al.

(10) Patent No.: US 7,232,161 B2
(45) Date of Patent: Jun. 19, 2007

(54) LATCH DEVICE FOR VEHICLE TAILGATE

(75) Inventors: Yosuke Matsuda, Yamanashi-ken (JP); Miki Ogino, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/245,716

(22) Filed: Sep. 18, 2002

(65) Prior Publication Data

US 2003/0227177 A1 Dec. 11, 2003

(30) Foreign Application Priority Data

Sep. 18, 2001 (JP) ..... 2001-283234

(51) Int. Cl.
*E05C 19/10* (2006.01)
*E05C 3/06* (2006.01)

(52) U.S. Cl. ..... 292/100; 292/201; 292/216; 292/DIG. 23; 292/DIG. 65; 49/287

(58) Field of Classification Search ..... 292/100, 292/201, 216, DIG. 65, DIG. 23, DIG. 42, 292/DIG. 43; 49/287
See application file for complete search history.

(56) References Cited

U.S. PATENT DOCUMENTS 3,052,493 A * 9/1962 Hawver et al. ..... 292/5
3,785,186 A * 1/1974 James et al. ..... 70/240
4,157,844 A * 6/1979 Sarosy et al. ..... 292/48
4,487,441 A * 12/1984 Miyamoto et al. ..... 292/336.3
4,900,074 A * 2/1990 Kleefeldt et al. ..... 292/216
4,929,007 A * 5/1990 Bartczak et al. ..... 292/336.3
5,074,603 A * 12/1991 Brackmann ..... 292/216
5,092,638 A * 3/1992 Mizuki ..... 292/216
5,211,436 A * 5/1993 Feder ..... 296/76
5,308,128 A * 5/1994 Portelli et al. ..... 292/216
5,678,870 A * 10/1997 Pelletier ..... 292/244
5,876,074 A * 3/1999 Dowling ..... 292/201
5,947,536 A * 9/1999 Mizuki et al. ..... 262/201
6,003,910 A * 12/1999 Dupont et al. ..... 292/201
6,068,308 A * 5/2000 Molzer ..... 292/336.3
6,076,868 A * 6/2000 Roger et al. ..... 292/201
6,131,337 A * 10/2000 Machida ..... 49/280
6,142,540 A * 11/2000 Girard et al. ..... 292/216

(Continued)

FOREIGN PATENT DOCUMENTS

GB 2 357 548 A 6/2001

*Primary Examiner*—Brian E. Glessner
*Assistant Examiner*—Carlos Lugo
(74) *Attorney, Agent, or Firm*—Browdy and Neimark, PLLC

(57) ABSTRACT

A latch device for a vehicle tailgate comprises a latch/ratchet mechanism, an open mechanism, a lock mechanism, and, an actuator for switching the lock mechanism to an unlocked state and a locked state. The lock mechanism includes a lock lever turning about a lock shaft. The actuator includes an output shaft which turns the lock lever through the lock shaft. The lock shaft is structured so that manual operational access is possible through a service hole in the tailgate or the vehicle body for turning the lock lever. One end of the output shaft penetrates a housing of the actuator to be connected to the lock shaft, and the other end of the output shaft is exposed to the outside through a shaft hole of the housing, and the manual access is applied to the other end of the output shaft.

6 Claims, 10 Drawing Sheets

U.S. PATENT DOCUMENTS 6,199,923 B1 * 3/2001 Rice et al. ..... 292/216
6,223,468 B1 * 5/2001 Kobayashi ..... 49/280
6,349,982 B2 * 2/2002 Fayngersh et al. ..... 292/165
6,378,920 B1 * 4/2002 Ostrowski et al. ..... 292/216
6,499,776 B2 * 12/2002 Takamura ..... 292/201
6,557,911 B2 * 5/2003 Nelsen et al. ..... 292/216
6,637,783 B2 * 10/2003 Takamura ..... 292/201
6,666,482 B2 * 12/2003 Hansen et al. ..... 292/24
6,669,247 B2 * 12/2003 Swan ..... 292/201
6,805,387 B1 * 10/2004 Williams et al. ..... 292/216

* cited by examiner

LATCH DEVICE FOR VEHICLE TAILGATE

BACKGROUND OF THE INVENTION

1. Field of the Invention

The present invention relates to a latch device for a vehicle tailgate, and more particularly, relates to a gate latch device which is switched to the locked state and the unlocked state by a motorized actuator. The present tailgate latch device has no key cylinder for a tailgate.

2. Description of the Related Art

As shown in FIG. 29, a conventional tailgate latch device has a latch unit A provided to a tailgate, a striker B fixed to a vehicle body, and an open handle C of the tailgate. The latch unit A has a latch/ratchet mechanism D which keeps the tailgate in the closed state in cooperation with the striker B, an open mechanism E which is connected to the open handle C, and a lock mechanism F which is provided between the open mechanism E and the latch/ratchet mechanism D.

The lock mechanism F is switched toga locked state and an unlocked state by an operating force of a key cylinder G or an actuator H. In the locked state, there is no connection between the open mechanism E and the latch/ratchet mechanism D, and the opening operating force of the open handle C does not come over to the latch/ratchet mechanism D, so that the tailgate is not opened.

Recently, the key cylinder G is often omitted from the tailgate latch device. In this case, only the actuator H can switch the lock mechanism F to the locked state and the unlocked state. The actuator H is operated by a signal from an operation switch J provided near the driver seat or a portable transmitter K.

A latch device with no key cylinder G needs means for preventing the impossibility of switching between the locked state and the unlocked state of the lock mechanism F because of a mechanical or an electrical trouble.

SUMMARY OF THE INVENTION

Accordingly, it is an object of the present invention to provide a tailgate latch device wherein an access for switching the lock mechanism from the vehicle interior side is possible even if the actuator gets in the impossibility of operation.

DESCRIPTION OF THE PREFERRED EMBODIMENTS

Figure 1:
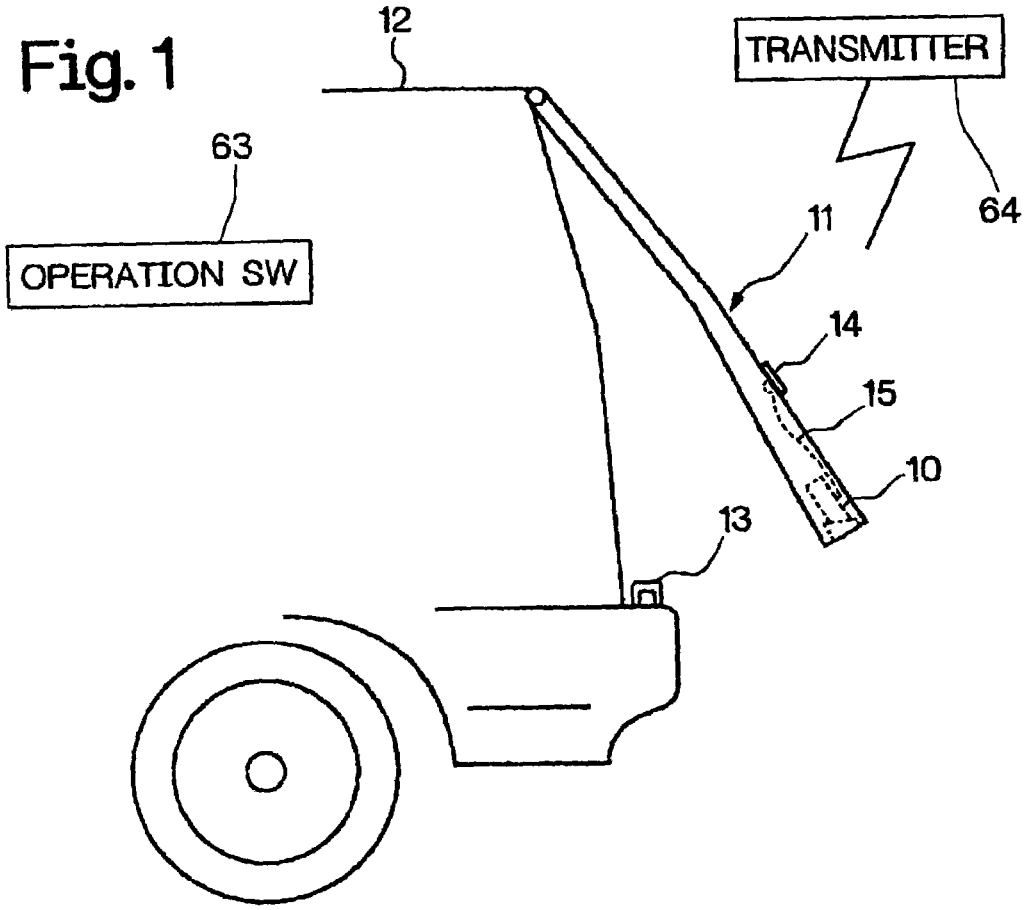
FIG. 1 is a view showing the rear end of a vehicle where a gate latch device according to the present invention is mounted.

Preferred embodiments of the present invention will be described by referring to drawings. As shown in FIG. 1, a tailgate latch device of the present invention comprises a latch unit 10 attached to a tailgate 11 and a striker 13 fixed to a vehicle body 12. The latch unit 10 is connected to an exposed open handle of the tailgate 11 through a wire cable 15.

The latch unit 10 mainly comprises a latch/ratchet mechanism 16 (FIG. 6) which keeps the tailgate 11 in a closed state in cooperation with the striker 13, an open mechanism 17 (FIGS. 7 and 8) which is connected to the open handle 14 through the wire cable 15, a lock mechanism 18 which is switched to an unlocked state where the open mechanism 17 is connected to the latch/ratchet mechanism 16 and a locked state where the open mechanism 17 its separated from the latch/ratchet mechanism 16, and a motorized actuator 19 which switches the lock mechanism 18 to the unlocked state and the locked state.

Figure 6:
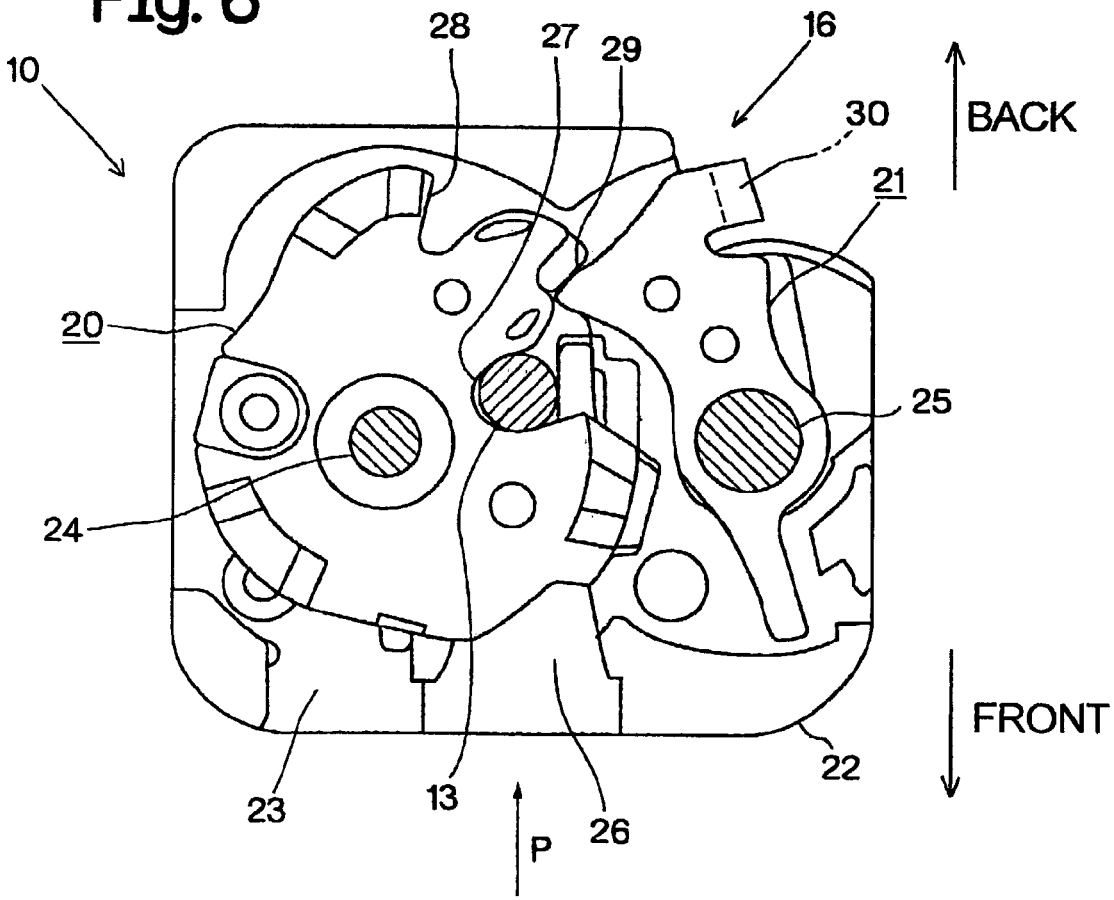
FIG. 6 is a bottom view showing a latch/ratchet mechanism of the latch unit.
Figure 7:
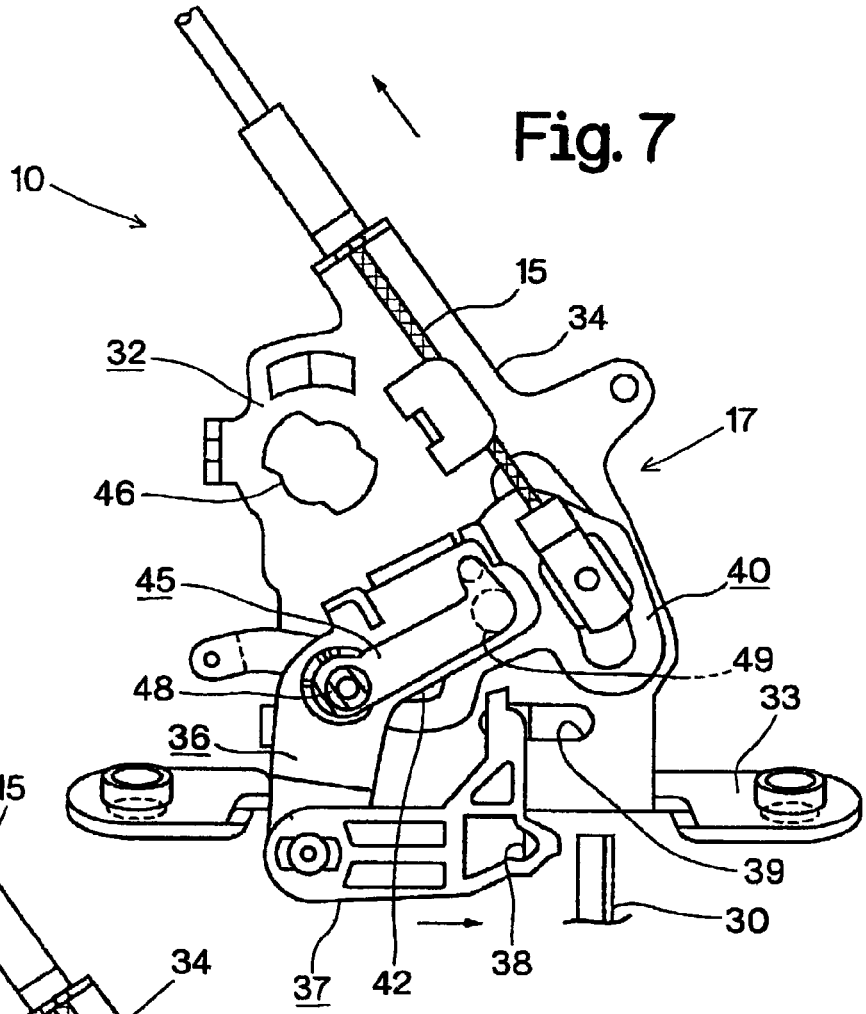
FIGS. 7 and 8 are rear views showing an open mechanism or the like of the latch unit.

As shown in FIG. 6, the latch/ratchet mechanism 16 comprises a metal latch 20 which is engaged with the striker 13 when the tailgate 11 is closed and a metal ratchet 21 which keeps the engagement between the latch 20 and the striker 13. The latch 20 is rotatably contained in a concave portion 23 formed at the lower part of a latch body 22 by using a latch shaft 24, and the ratchet 21 is rotatably contained in the concave portion 23 by using a ratchet shaft 25.

The latch 20 is urged in the clockwise direction in FIG. 6 by the elasticity of a latch spring (not shown), and the ratchet 21 is urged in the counterclockwise direction by the elasticity of a ratchet spring (not shown). When the tailgate is moved toward a closed position, the striker 13 goes into a striker passage 26 formed in the latch body 22 along an arrow P to come into contact with a U-shaped groove 27 of the latch 20, and consequently, the latch 20 turns counterclockwise against the elasticity of the latch spring, and when the latch 20 turns to a half-latched position, the ratchet 21 is engaged with a first step 28 of the latch 20 so that the tailgate 11 is positioned at a half-closed position, and furthermore, when the latch 20 reaches a full-latched position, the ratchet 21 is engaged with a second step 29 of the latch 20, and the tailgate 11 is kept at a full-closed position.

The ratchet 21 has a ratchet pin 30 projecting to the upper side of the latch body 22. The ratchet 21 releases the latch 20, when turning clockwise in FIG. 6, so as to open the tailgate 11. The latch body 22 is contained in a metal bottom plate 31 shaped like a rectangular rim dish, and the concave portion 23 is substantially covered by the bottom plate 31.

Figure 2:
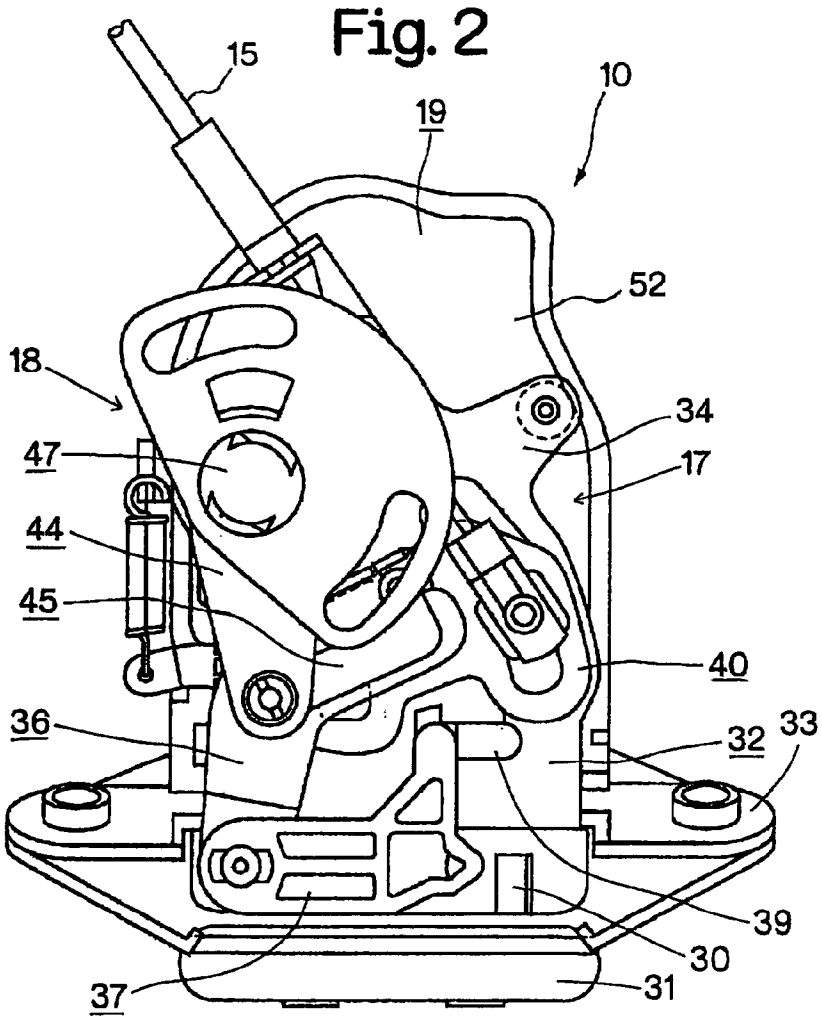
FIG. 2 is a rear view of a latch unit of the latch device.
Figure 3:
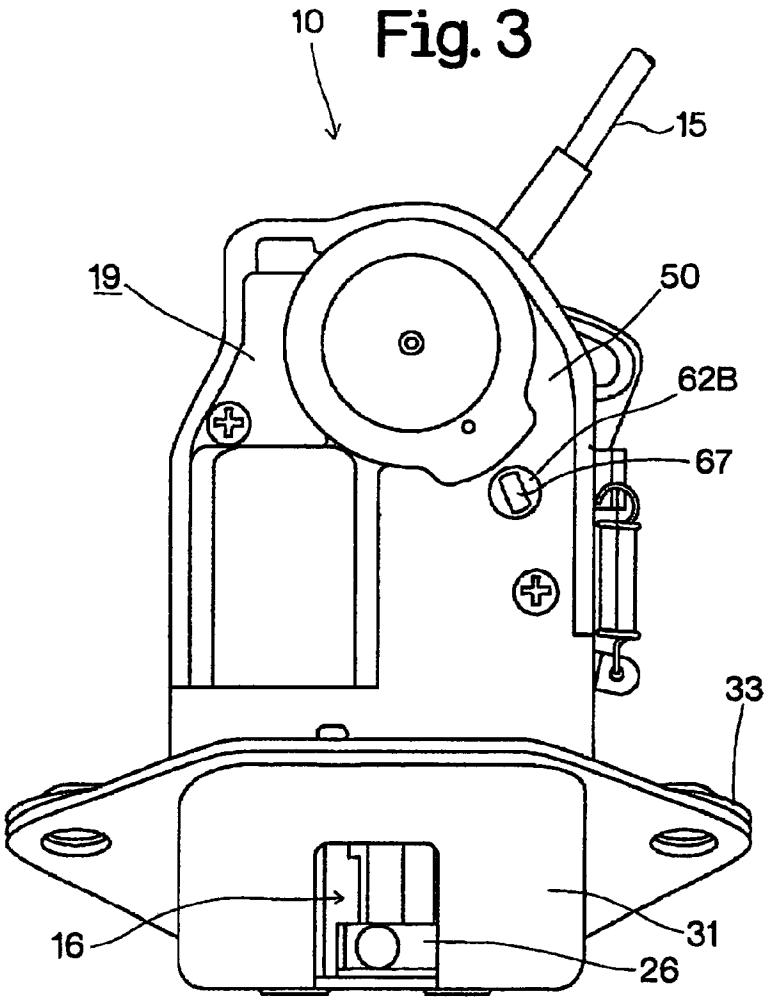
FIG. 3 is a front view of the latch unit.
Figure 4:
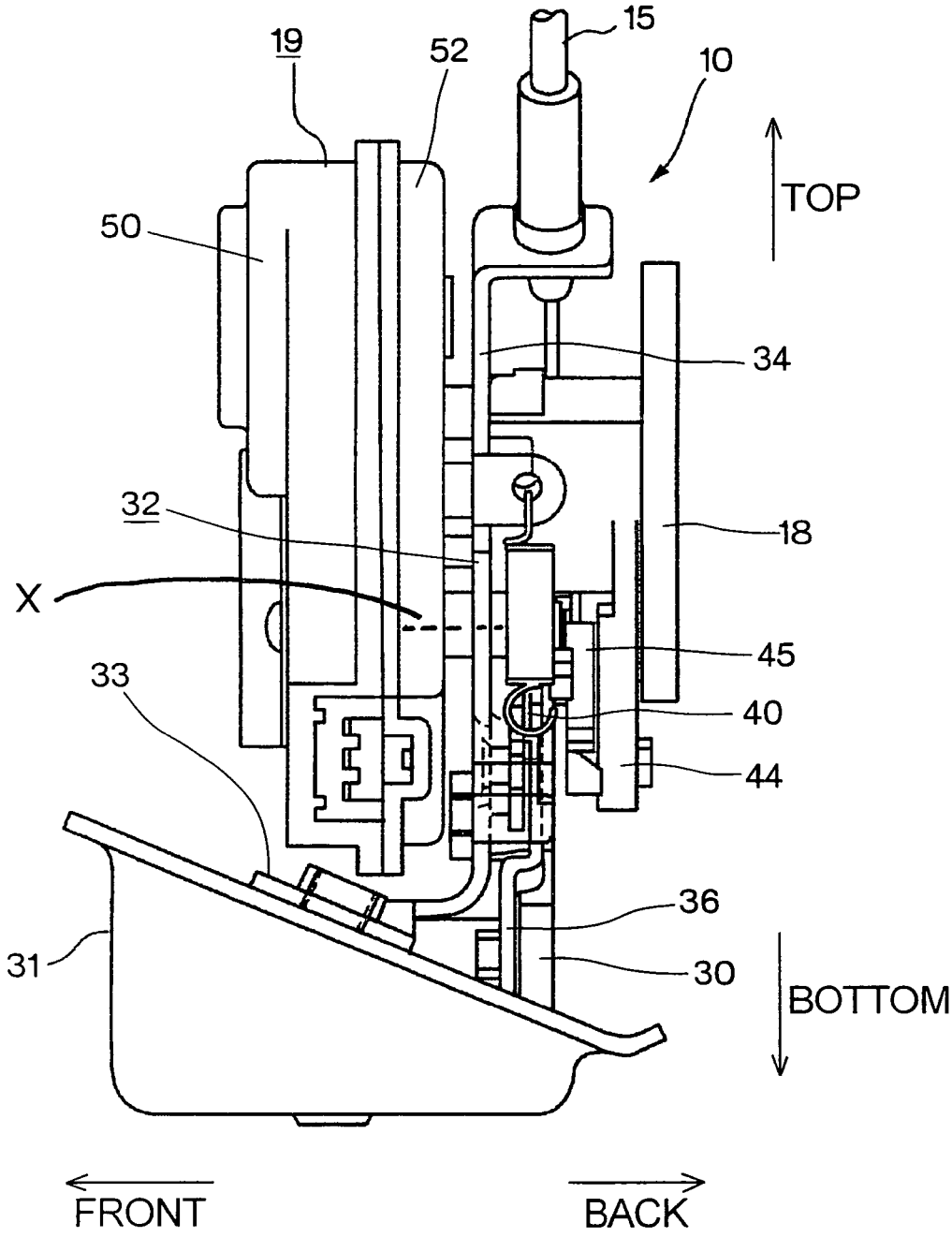
FIG. 4 is a side view of the latch unit.
Figure 5:
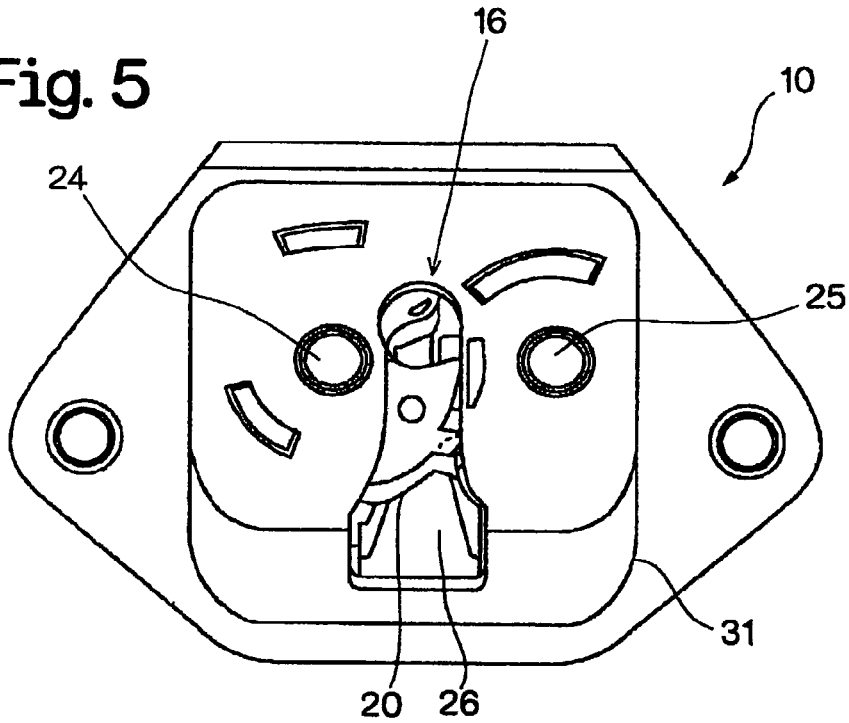
FIG. 5 is a bottom view of the latch unit.

As shown in FIGS. 2 to 4, on the upper side of the bottom plate 31, a metal upper plate 32 is fixed. The latch body 22 is surrounded by the bottom plate 31 and the upper plate 32. The upper plate 32 comprises a bent plate 33 fixed to the bottom plate 31 and an upright plate 34.

Figure 8:
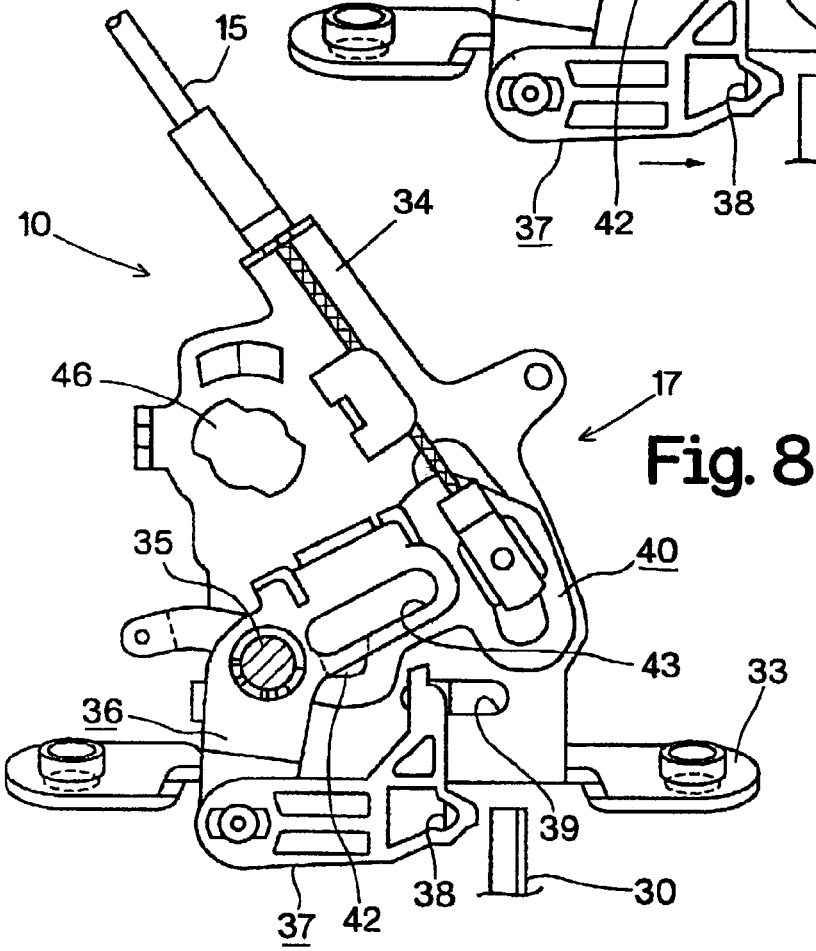
Figure 14:
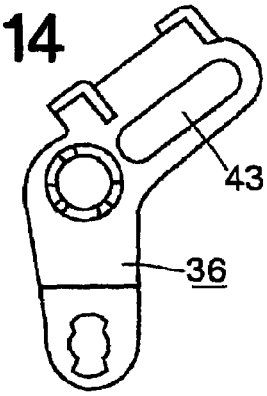
FIG. 14 is a rear view of a ratchet lever of the latch unit.
Figure 13:
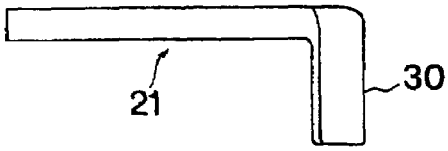
FIG. 13 is a side view of the ratchet.
Figure 16:
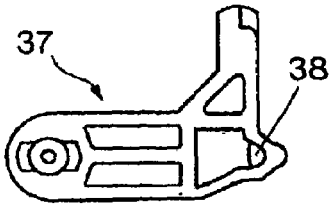
FIG. 16 is a rear view of a ratchet link of the latch unit.
Figure 18:
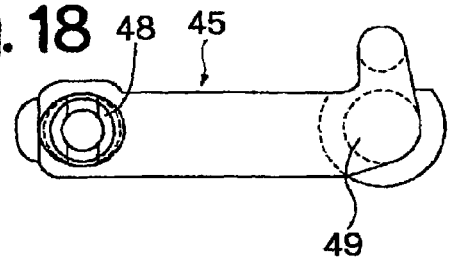
FIG. 18 is a rear view of a lock link of the lock mechanism.
Figure 17:
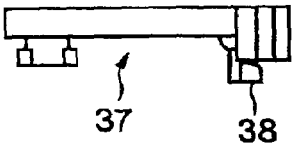
FIG. 17 is a plan view of the ratchet link.

As shown in FIG. 8, on the backside of the upright plate 34 of the upper plate 32, a ratchet lever 36 (FIG. 14) is rotatably supported by a support shaft 35. The left end of a ratchet link 37 is connected to the ratchet lever 36, and the right end of the ratchet link 37 is slidably engaged with a slot 39 formed in the upright plate 34. The ratchet link 37 slides to the right in FIG. 8 when the ratchet lever 36 turns, and a projecting part 38 at the right end of the ratchet link 37 comes into contact with the ratchet pin 30 of the ratchet 21 to separate the ratchet 21 from the latch 20.

Figure 15:
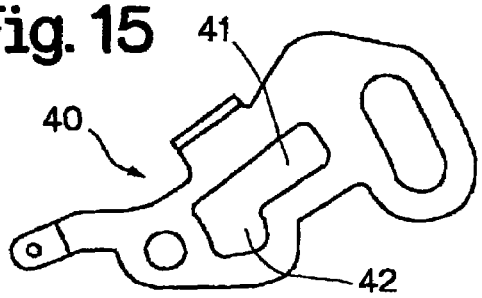
FIG. 15 is a rear view of an open lever of the latch unit.
Figure 12:
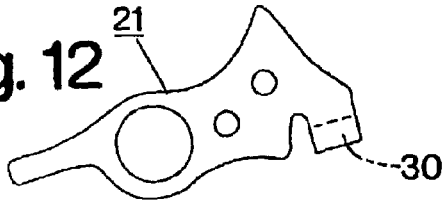
FIG. 12 is a rear view of a ratchet of the latch/ratchet mechanism.

The open mechanism 17 has an open lever 40 (FIG. 15) which is connected to the open handle 14 through the wire cable 15. The open lever 40 is rotatably supported by the support shaft 35, and turns counterclockwise in FIGS. 7 and 8 by the opening operation of the open handle 14. The open lever 40 has a slot 41 extending in the radial direction of the support shaft 35 and a free play concave part 42 communicating with the slot 41, and the ratchet lever 36 has a slot 43 corresponding to the slot 41.

Figure 19:
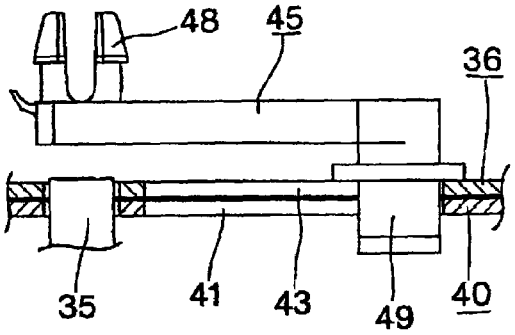
FIG. 19 is a cross sectional view showing the relation of the lock link, the open lever, and the ratchet lever.
Figure 20:
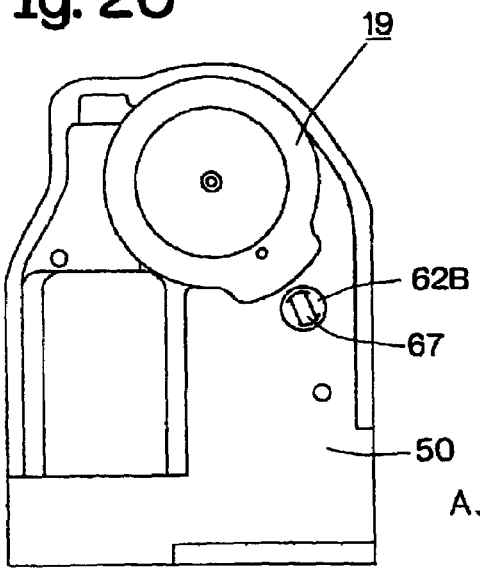
FIG. 20 is a front view of an actuator of the latch unit.
Figure 21:
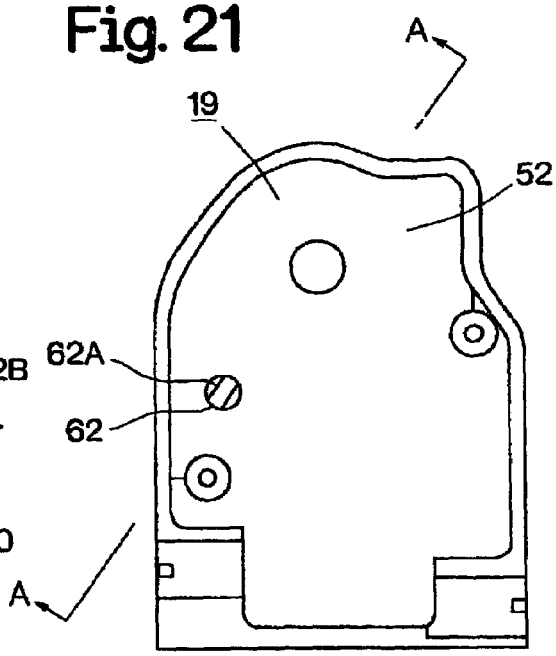
FIG. 21 is a rear view of the actuator.
Figure 22:
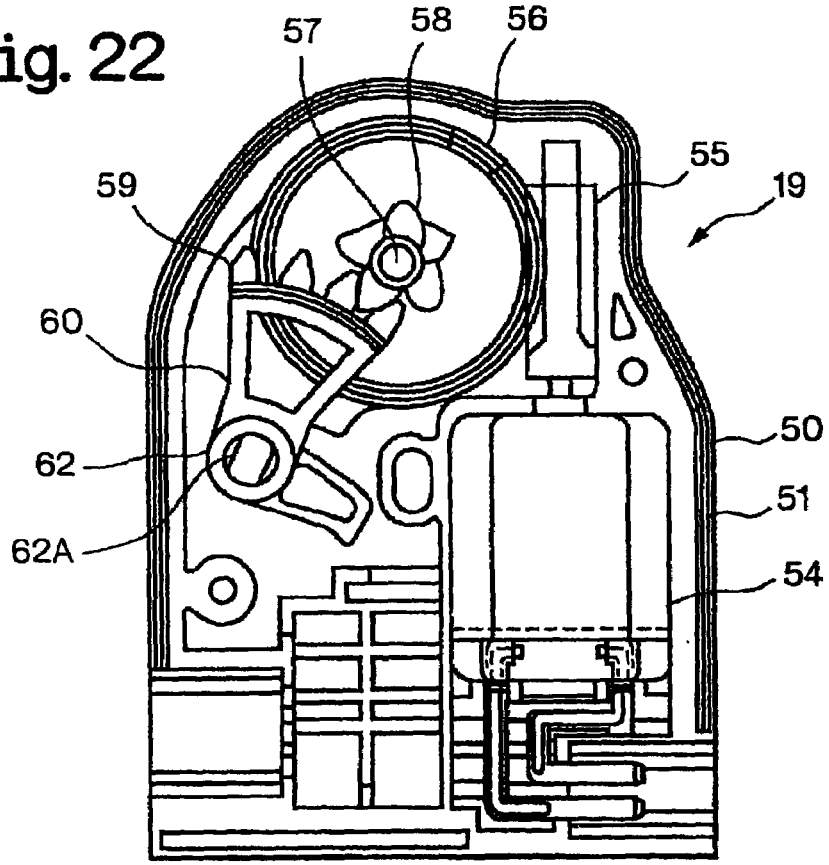
FIG. 22 is a rear view showing the interior of the actuator.

The lock mechanism 18 switches the open lever 40 and the ratchet lever 36 to the connected state (unlocked state) and the disconnected state (locked state). The lock mechanism 18 comprises a lock lever 44 and a lock link 45. The lock lever 44 integrally has a lock shaft 47 which projects to the front side of the upright plate 34 through a hole 46 of the upper plate 32 to be connected to the actuator 19. A cotter pin 48 at one end of the lock link 45 is connected to the lock lever 44, and a lock pin 49 at the other end of the lock link 45 is inserted into the slot 41 of the open lever 40 and the slot 43 of the ratchet lever 36, as shown in FIG. 19.

Figure 9:
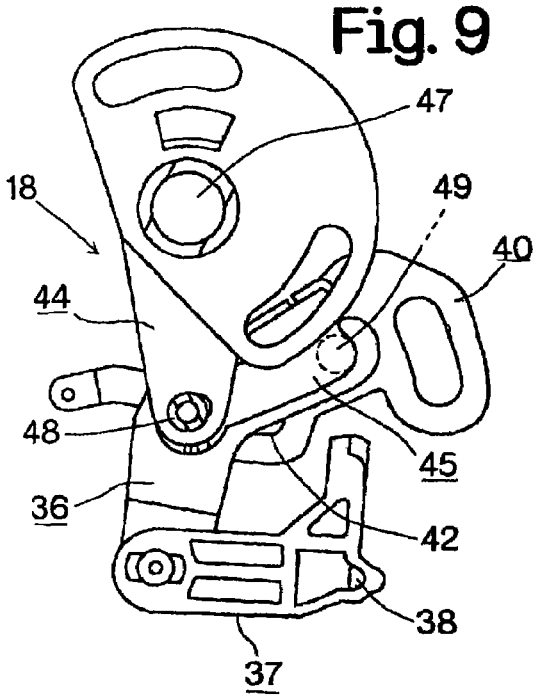
FIG. 9 is a rear view showing a lock mechanism of the latch unit in an unlocked state.
Figure 10:
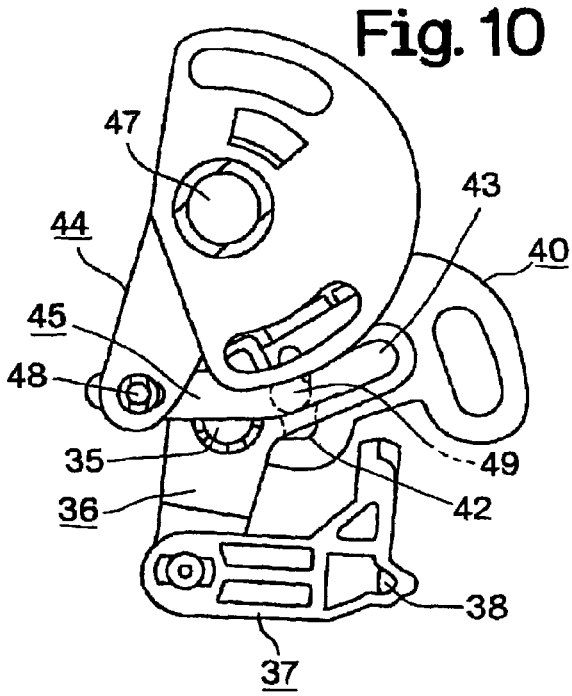
FIG. 10 is a rear view showing the latch unit in a locked state.
Figure 11:
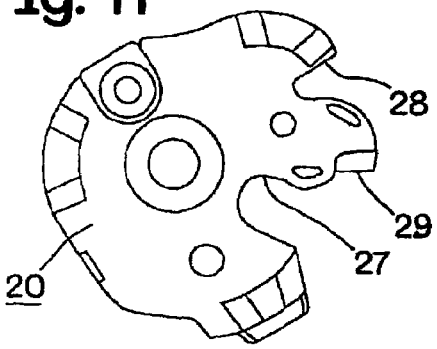
FIG. 11 is a rear view of a latch of the latch/ratchet mechanism.

The lock link 45 moves between the unlocked position (FIGS. 7 and 9) and the locked position (FIG. 10) along the slots 41, 43 when the lock lever 44 turns about the lock shaft 47 by an output of the actuator 19. When the lock link 45 is in the unlocked position, the open lever 40 and the ratchet lever 36 are connected with each other through the lock pin 49. Accordingly, when the open lever 40 turns, the ratchet lever 36 slides the ratchet link 37 to the right in FIG. 7, and the projecting part 38 of the ratchet link 37 comes into contact with the ratchet pin 30 of the ratchet 21 to separate the ratchet 21 from the latch 20, and the tailgate 11 is opened. On the contrary, when the lock link 45 is in the locked position, the lock pin 49 stands face to face with the free play concave part 42 of the open lever 40. Therefore, the rotation of the open lever 40 is not transmitted to the ratchet lever 36, and the tailgate 11 is not opened.

The actuator 19 is fixed on the front side of the upright plate 34 of the upper plate 32. Each member of the actuator 19 is contained in a housing 53 which comprises a base case 50 and a cover case 52 fixed to the base case 50 through a seal member 51. A cylindrical worm 55 is fixed to a motor shaft of a motor 54 of the actuator 19, and a worm wheel 56 is meshed with the cylindrical worm 55. A gear member 58 having five pieces of gear teeth 58A to 58E is fixed to a rotation shaft 57 of the worm wheel 56. The gear member 58 is meshed with a toothed portion 59 of an output lever 60 having four pieces of gear teeth 59A to 59D. When the motor 54 is not energized, the worm wheel 56 is kept at a neutral position by the elasticity of a neutral return spring 61, and the worm wheel 56 turns in both directions from the neutral position by the power of the motor 54. The structure leading to the output lever 60 from the motor 54 is described in detail in GB2,357,548A, and therefore, here, a simple description will be given as follows.

Figure 24:
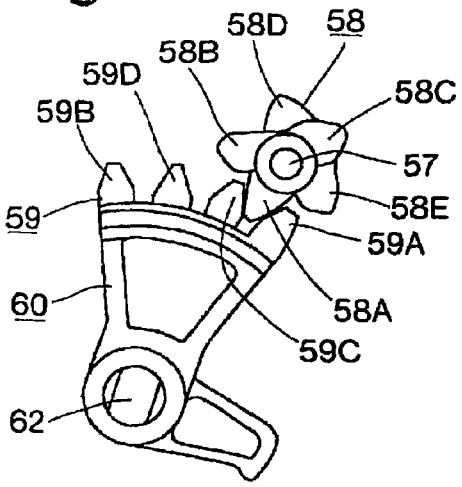
FIGS. 24 to 27 are explanatory figures showing the relation between an output lever and a gear of the actuator.
Figure 25:
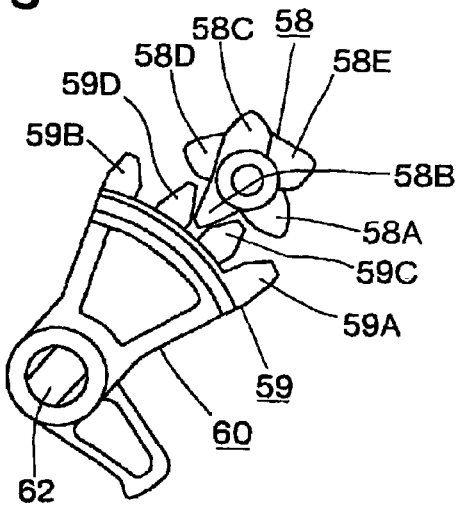
Figure 26:
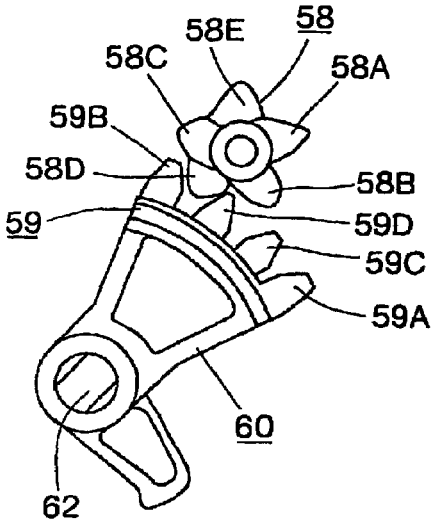
Figure 27:
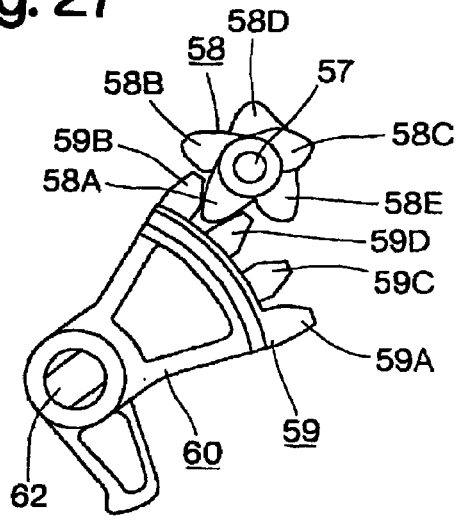
Figure 29:
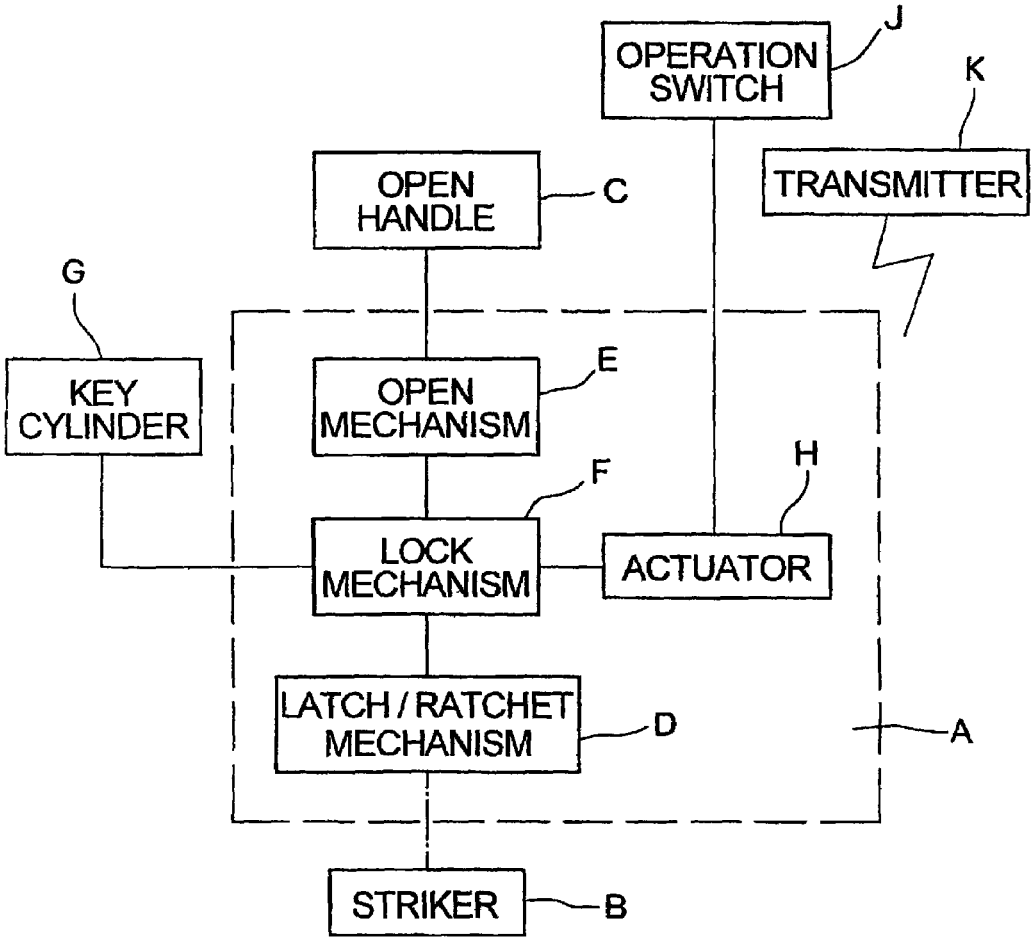
Fig. 29 (PRIOR ART)
FIG. 29 is a block diagram of a conventional tailgate latch device.

When the gear member 58 turns counterclockwise in a state of FIG. 24, the output lever 60 turns clockwise to be in a state of FIG. 25, and by a further counterclockwise rotation of the gear member 58, the output lever 60 changes into a state of FIG. 26, and the motor 54 is turned off. When the motor 54 is turned off, the worm wheel 56 (gear member 58) returns to the neutral position by the elasticity of the neutral return spring 61 without turning the output lever 60, and a state of FIG. 27 is made. Furthermore, in the state of FIG. 27, when the gear member 58 turns clockwise, the output lever 60 turns counterclockwise so that the state of FIG. 26 is made, and by a further clockwise rotation of the gear member 58, the output lever 60 changes into the state of FIG. 25, and the motor 54 is turned off. When the motor 54 is turned off, the worm wheel 56 (gear member 58) returns to the neutral position by the elasticity of the neutral return spring 61 without turning the output lever 60, and the state of FIG. 24 is made. Furthermore, when the worm wheel 56 is positioned at the neutral position, the rotation of the output lever 60 is not transmitted to the gear member 58. Accordingly, a one-way clutch is structured by the toothed portion 59 of the output lever 60 and the gear member 58 of the worm wheel 56.

Figure 23:
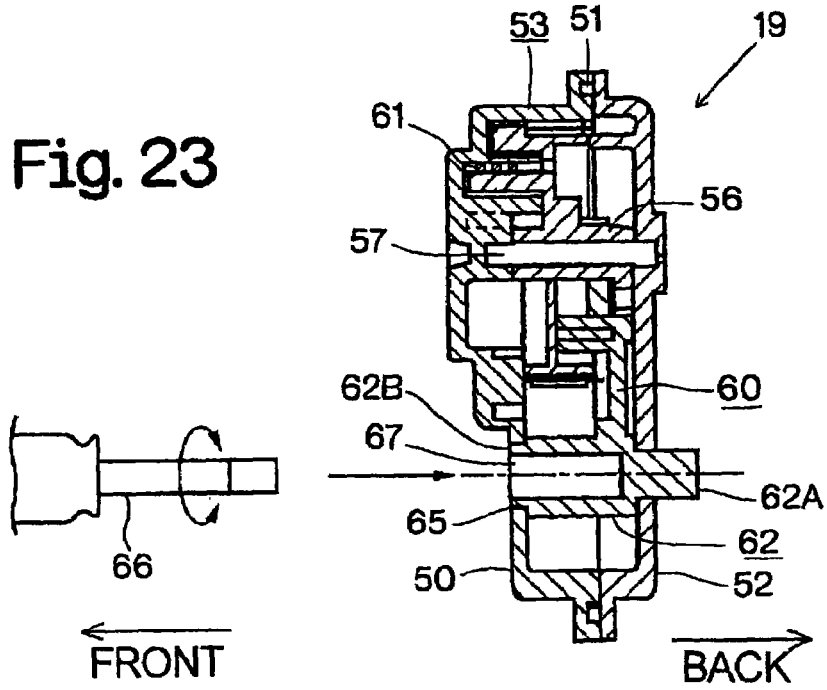
FIG. 23 is a cross sectional view of the actuator.

An output shaft 62 which turns with the output lever 60 as one-piece is rotatably supported by the base case 50 and the cover case 52. The back side portion of the output shaft 62, as a connecting shaft 62A, penetrates the cover case 52 to extend backward as shown in FIG. 23, and it is connected to the lock shaft 47 of the lock lever 44. Consequently, by the rotation of the output lever 60, the lock lever 44 is switched to the locked position and the unlocked position. A shaft center of the output shaft 62 is coincided with a shaft center of the lock shaft 47 as shown by dash line X in FIG. 4. The actuator 19 of the present invention operates by a signal from an operation switch 63 near the driver seat and/or a portable transmitter 64.

The front side portion of the output shaft 62, as an emergency shaft 62B, is exposed to the outside of the housing 53 through a shaft hole 65 in the base case 50 as shown in FIG. 23. The emergency shaft 62B is provided with an engaging part 67 having an approximately rectangular cross section which is engageable with a general-purpose tool 66 such as a minus screw driver.

Figure 28:
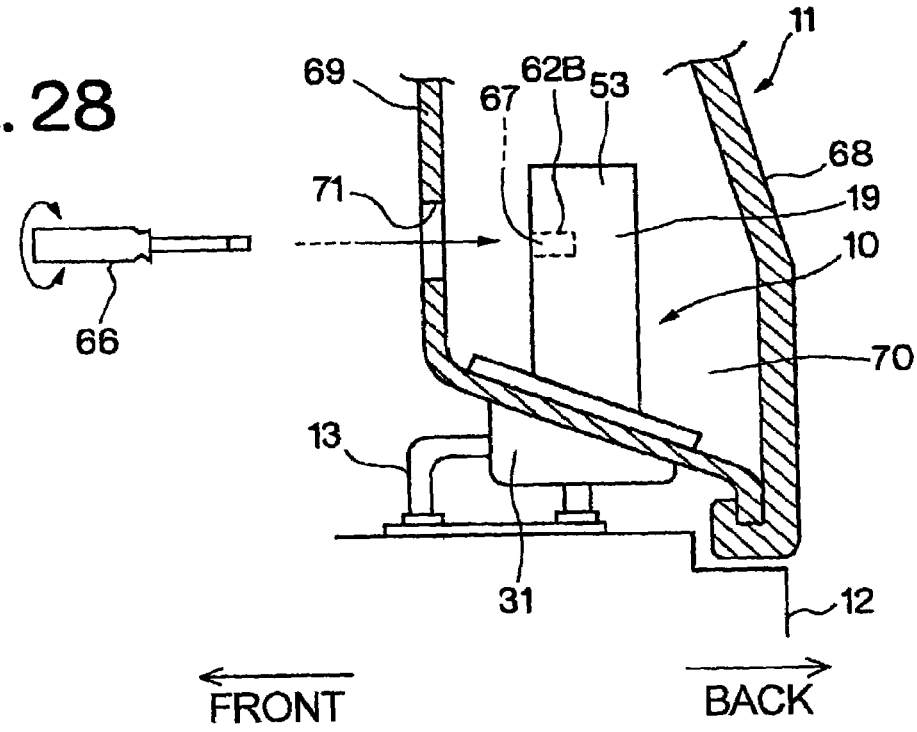
FIG. 28 is an explanatory figure showing an access method to the lock mechanism by a tool.

As shown in FIG. 28, the latch unit 10 is attached to the lower part of the tailgate 11, and the actuator 19 of the latch unit 10 is mounted in an interior space 70 surrounded by an outer metal panel 68 and an inner metal panel 69 of the tailgate 11. The output shaft 62 extends in the longitudinal direction of the vehicle body 12, and the emergency shaft 62B of the output shaft 62 is exposed at the front side of the housing 53 standing face to face with the inner metal panel 69, which is obvious from FIG. 28. Therefore, the engaging part 67 formed to the emergency shaft 62B can easily be accessed from a service hole 71 formed in the inner metal panel 69. The service hole 71 is covered by a removable lid (not shown in the figure).

The lock lever 44 is switched to the locked position and the unlocked position by the power of the actuator 19 in the normal use. Therefore, when the actuator 19 breaks down mechanically or electrically, the tailgate 11 cannot be unlocked and locked by the operation using the operation switch 63 and/or the portable transmitter 64. At the time like this, the lid is removed from the service hole 71 of the tailgate 11 after getting into the cargo room from the vehicle interior side. Next, the tool 66 such as a minus screw driver is engaged with the engaging part 67 of the emergency shaft 62B through the service hole 71 to turn the emergency shaft 62B (output shaft 62). Consequently, the lock lever 44 turns in a specified direction through the lock shaft 47, and the unlock and the lock of the tailgate 11 can be performed. At this moment, the output lever 60 also turns by the rotation of the output shaft 62, but the worm wheel 56 does not turn because of the one-way clutch function structured by the toothed portion 59 of the output lever 60 and the gear member 58 of the worm wheel 56.

The actuator 19 of the present invention is arranged on the front side of the upright plate 34 of the upper plate 32, and the open lever 40 and the lock lever 44 are arranged on the back side of the upright plate 34. But there is also a case where it is preferable that the actuator 19 is arranged on the back side of the upright plate 34 and that the open lever 40 and the lock lever 44 are arranged on the front side of the upright plate 34 because of the influence of the shape of the tailgate 11 or the position of the ratchet pin 30. In the case like this, the access through the service hole 71 can easily reach the lock lever 44 without being interrupted by the upright plate 34 or the housing 53 of the actuator 19, and therefore, it is sufficient to form the engaging part 67 which can be engaged with the tool 66 at the end part of the lock shaft 47.

In the above, there is also a case where the latch unit 10 is attached not to the tailgate 11 but to the vehicle body 12, and the striker 13 is attached not to the vehicle body 12 but to the tailgate 11. In this case, the service hole 71 which is used for the mounting of the latch unit 10 is also naturally provided on the vehicle body 12 side.

Advantages

In the case of the lock mechanism 18 according to the present invention, the access through the service hole 71 of the tailgate 11 from the cargo room is possible. Therefore, even if the actuator 19 gets into a failure because of a failure of the battery or a trouble of the actuator, the unlock and the lock of the tailgate 11 can be performed.

Furthermore, the access for switching the lock mechanism 18 is applied to the lock shaft 47 of the lock lever 44 or the output shaft 62 of the actuator 19, and therefore, increase of furnishings can be prevented.

Furthermore, even in the case where the lock shaft 47 of the lock lever 44 is shut out from the service hole 71 of the tailgate 11 by the upright plate 34 of the back plate 32 or the housing 53 of the actuator 19, the lock shaft 47 can be turned through the output shaft 62 of the actuator 19 by an access through the service hole 71.

What is claimed is:

1. A latch device for a vehicle tailgate, comprising:

a latch/ratchet mechanism arranged to keep a tailgate in a closed state in cooperation with a striker fixed to a vehicle body;

an open mechanism for connection to an open handle of the tail gate;

a lock mechanism provided between the open mechanism and the latch/ratchet mechanism, said lock mechanism being switched to an unlocked state where the open mechanism is connected to the latch/ratchet mechanism and a locked state where the open mechanism is separated from the latch/ratchet mechanism;

an actuator for switching the lock mechanism to the unlocked state and the locked state;

said lock mechanism including a lock lever which turns about a lock shaft between the unlocked state and the locked state; said actuator including an output shaft which turns the lock lever through the lock shaft;

wherein said output shaft is structured so that manual operational access thereto is possible from inside the vehicle through a service hole in the tailgate for turning the lock lever between the unlocked state and the locked state when the tailgate is closed; and wherein one end of the output shaft penetrates a housing of the actuator to be connected to the lock shaft, and the other end of the output shaft is exposed to the outside through a shaft hole of the housing, and said manual access is applied to the other end of the output shaft.

2. The latch device for a vehicle tailgate according to claim 1, wherein the output shaft includes an engaging part with which a general-purpose tool can be engaged.

3. The latch device for a vehicle tailgate according to claim 2, wherein the general-purpose tool comprises a minus screw driver.

4. The latch device for a vehicle tailgate according to claim 1, wherein the other end of the output shaft extends toward a panel where the service hole is formed.

5. The latch device for a vehicle tailgate according to claim 1, wherein an engaging part with which a general-purpose tool can be engaged is provided to the other end of the output shaft.

6. The latch device for a vehicle tailgate according to claim 1, wherein a shaft center of the output shaft is coincided with a shaft center of the lock shaft.

* * * * *